US006607103B2

(12) United States Patent
Gerenraich et al.

(10) Patent No.: US 6,607,103 B2
(45) Date of Patent: Aug. 19, 2003

(54) TOUCH FREE DISPENSER

(75) Inventors: Kenneth B. Gerenraich, Seal Beach, CA (US); John J. Cogger, Irvine, CA (US)

(73) Assignee: Gerenraich Family Trust, Seal Beach, CA (US)

( * ) Notice: Subject to any disclaimer, the term of this patent is extended or adjusted under 35 U.S.C. 154(b) by 0 days.

(21) Appl. No.: 10/269,565

(22) Filed: Oct. 11, 2002

(65) Prior Publication Data

US 2003/0075565 A1 Apr. 24, 2003

Related U.S. Application Data

(60) Provisional application No. 60/329,162, filed on Oct. 12, 2001.

(51) Int. Cl.[7] ..... B67D 5/06

(52) U.S. Cl. ..... 222/183; 222/209; 222/214; 222/325

(58) Field of Search ..... 222/209, 214, 222/325, 207, 183, 131, 326, 327, 333

(56) References Cited

U.S. PATENT DOCUMENTS 4,673,109 A * 6/1987 Cassia ..... 222/209
4,722,372 A * 2/1988 Hoffman et al. ..... 222/214
4,946,070 A * 8/1990 Albert et al. ..... 222/214
4,974,753 A * 12/1990 Tucker et al. ..... 222/325
5,100,030 A * 3/1992 Roggenburg, Jr. et al. . 222/325
5,255,822 A * 10/1993 Mease et al. ..... 222/214
5,492,247 A * 2/1996 Shu et al. ..... 222/207
6,016,853 A * 1/2000 Wang ..... 222/207

* cited by examiner

*Primary Examiner*—Philippe Derakshani
(74) *Attorney, Agent, or Firm*—Walter A. Hackler

(57) ABSTRACT

A touch free dispenser includes a sealed collapsible bottle assembly for containing a dispensable fluid, the assembly including a collapsible container with a depending coupler, a fluid pump disposed within the coupler and a dispensing tip, in fluid communication with the pump and container, for both activating the pump and dispensing the fluid. A support frame is provided for removably receiving the bottle assembly with the container supported on a topside of the frame, the frame having an opening therethrough for enabling the tip to dispense fluid therethrough. A pump actuator, disposed on a bottom side of the frame is provided for engaging the tip in order to actuate the pump. A driver assembly, disposed on the frame bottom side operates the pump actuator in response to the electronic signal, and a controller senses a presence of a user's hand proximate the dispensing tip and provides the electronic signal to the driver.

17 Claims, 5 Drawing Sheets

TOUCH FREE DISPENSER

The present application is a continuation of U.S. Ser. No. 60/329,162 filed Oct. 12, 2001.

The present invention generally relates to an electronically controlled fluid dispenser and is more particularly related to a touch free dispenser for fluids, such as soap or the like, which is aseptic in operation.

Many heretofore fluid dispensers have been mechanical in operation and require a user to actuate a pumping mechanism by either hand or foot. Such operation, particularly by hand, is not considered sanitary and is undesirable for use in medical and dental facilities. Typical foot actuated fluid dispensers are typically unwieldly, cumbersome in operation, bulky and expensive.

Accordingly, a need exists for an inexpensive, compact and relatively small electronically controlled fluid dispenser for universal clinical application in medical and dental facilities, as well as industrial and commercial institutions.

The present invention provides for a dispenser with a totally sealed replaceable bottle assembly which may include a variety of dispensing tips which are indexed with the dispenser. This indexing arrangement enables implementation of various territorial features which uniquely match a matrix of filled bottle assemblies with different customers, different products, or different geographic locations.

SUMMARY OF THE INVENTION

A touch free dispenser in accordance with the present invention generally includes a bottle assembly for containing a dispensable fluid with the bottle assembly including container having a dispensing coupler, a fluid pump disposed within a coupler and a dispensing tip, in fluid communication with a pump and container, for both activating the pump and dispensing a fluid.

A support frame is provided for receiving the bottle assembly with the container supported on a topside of the frame. The frame preferably includes an opening therethrough for enabling the tip to dispense fluid.

A flange extending radially from the coupler and a depression disposed in a frame topside enables keyed capture of the flange. As hereinabove noted, this provides a territorial feature for uniquely matching bottle assembly and frame in order to not only differentiate products by preventing a capture of a bottle to the frame to prevent an undesired combination, but also provides for the ability to vend product having special features adapted for specific uses.

A pump actuator is disposed on a bottom side of the frame for engaging the tip in order to actuate the pump and a driver assembly is disposed on the frame bottom side for operating the pump actuator in response to an electric signal. A controller is provided for sensing the presence of a user and providing the electrical signal to the driver.

More specifically, the flange and depression may have corresponding asymmetric shapes to effect the keyed capture therebetween.

Preferably, the container is collapsible and includes accordion like convolutions in walls of the container for enabling collapse as fluid is withdrawn. This, in turn, enables the bottle assembly to be sealed and fixing of the coupler to the container, provides for disposability of the bottle assembly.

An arm is disposed on the frame topside for releasably engaging the flange and the dispensing tip further includes an outwardly projecting flange for engaging the pump actuator. The pump actuator preferably surrounds the dispensing tip and the pump actuator includes a lifting surface, so that a driver assembly, which includes a rotated lifter, may be arranged for engaging the lifting surface during a portion of revolution. A plurality of posts are provided for supporting the collapsible container above the frame top plate and positioning the pump and tip for engagement by the actuator.

BRIEF DESCRIPTION OF THE DRAWINGS

The advantages and features of the present invention will be better understood by the following description when considered in conjunction with the accompanying drawings, in which.

DETAILED DESCRIPTION

Figure 1:
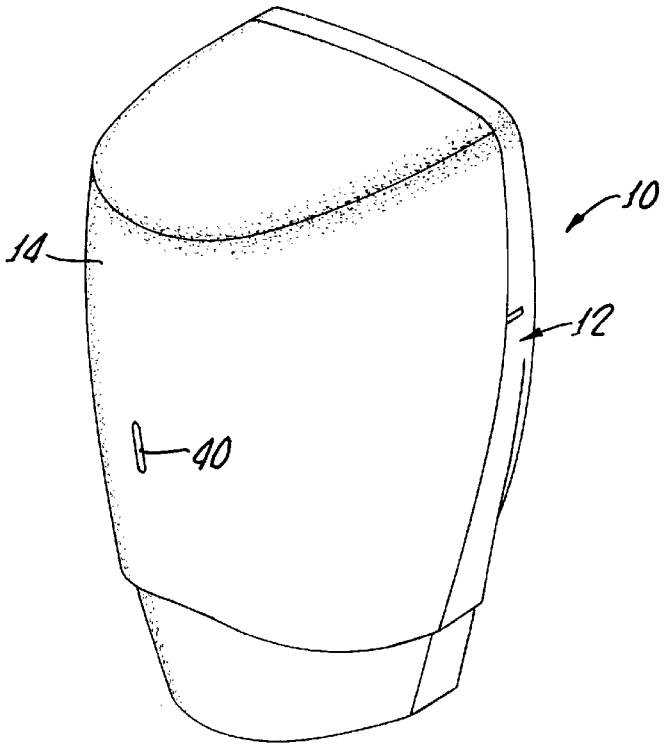
FIG. 1 is a perspective view of a touch free dispenser in accordance with the present invention generally showing a housing and a cover.
Figure 2:
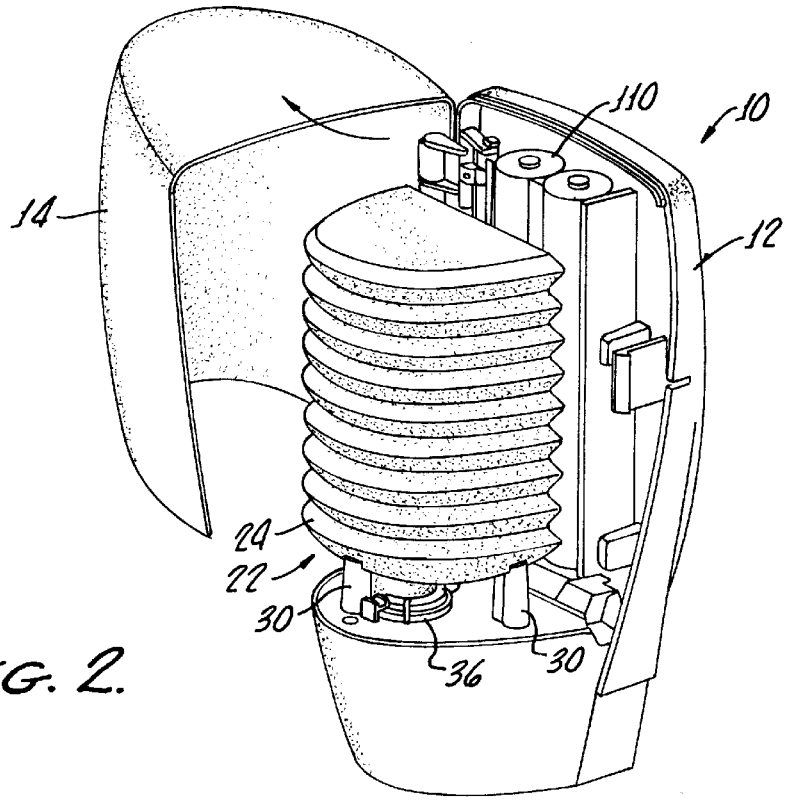
FIG. 2 is similar to FIG. 1 showing the cover in a hinged open position revealing a bottle assembly with a collapsible container.

With reference to FIGS. 1 and 2, there is shown a touch free dispenser 10 generally including a housing 12 and a cover 14, a hinge 16 between the housing 12 and cover 14 enables access and replacement of a bottle assembly 22 which includes a collapsible container 24 supported by posts 30 upstanding from a frame 36.

The collapsible container 24 may, for example, contain between 1 and 1.5 liters of liquid media and is replaceable when empty. A remaining capacity of the container 24 may be visually perceived by a window 40 in the cover 14 (see FIG. 1) and may be evacuated to within 2.4% of its filled volume to provide for efficient handing of the fluid media. A suitable container 24 is described in U.S. Ser. No. 10/269, 512 filed on even date herewith and entitled: Battery Bottle. This application is to be incorporated herewith in its entirety including all drawings and specifications for describing a bottle suitable for the present invention.

Figure 3:
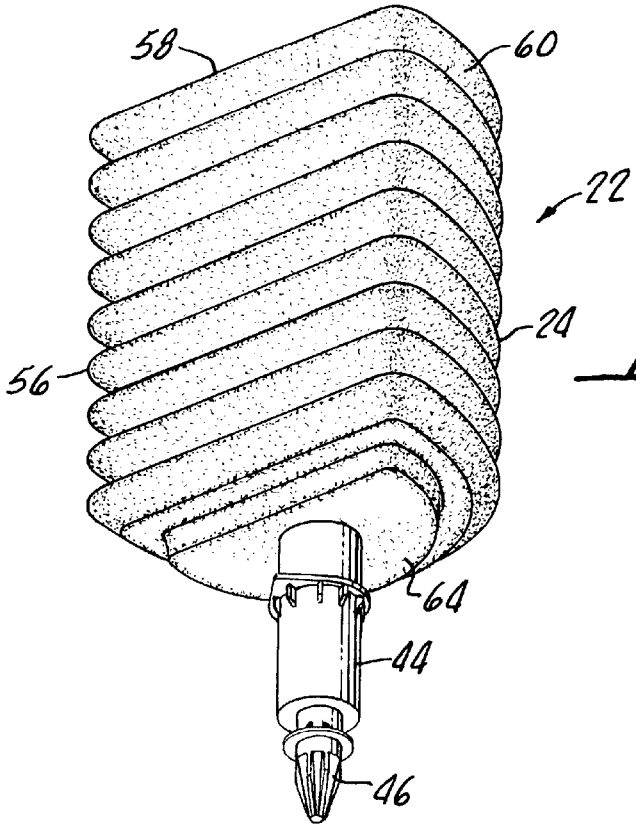
FIG. 3 is a perspective view of a sealed collapsible bottle assembly in accordance with the present invention for containing a dispensable fluid, the bottle assembly being attached to a depending coupler and dispensing tip.
Figure 4:
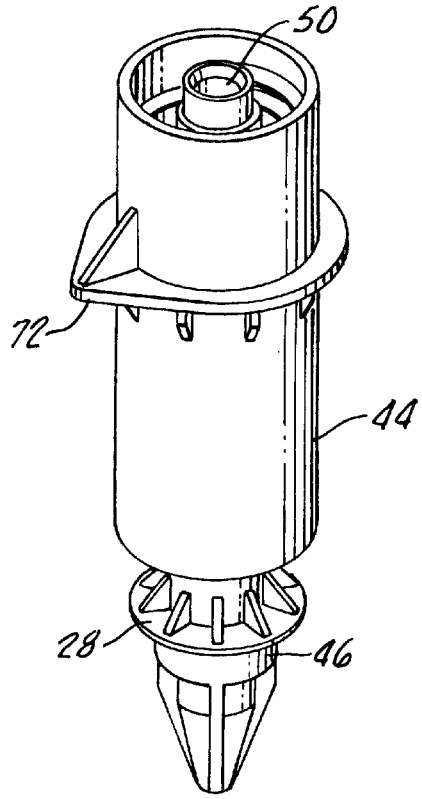
FIG. 4 is an enlarged perspective view of the coupler shown in FIG. 3 more particularly illustrating a flange extending radially from the coupler, a flange on the dispensing a tip and a pump disposed within the coupler.

With reference again to FIG. 3, the bottle assembly 22 further includes a dispensing coupler 44 and a dispensing tip 46 in fluid communication with a pump 50 disposed within the coupler 44 for both activating the pump and dispensing the fluid as hereinafter described.

The pump 50 is of conventional design and is actuated by axial movement of the tip 46 to dispense metered amounts of fluid through the tip 50 upon a lifting action of the tip 46 with respect to the pump 50 and the coupler 44 as hereinafter described. It should be appreciated that any axially operated fluid pump may be utilized in combination with, and disposed within, the coupler 44 depending upon the viscosity of the fluid to be dispensed.

With reference again to FIG. 3 the collapsible container 24 is designed with pleats 56 or accordion like convolutions, in walls 58, 60. Through the use of a thermoplastic of sufficiently soft durometer and wall thickness to act as a compliant member, the container 24 will collapse under a pressure differential which occurs during dispensing of a previously filled product through the actuated pump 50 and tip 46. Preferably, the thermoplastic material also exhibits favorable WVTR (water vapor transfer rate) and low oxygen permeability.

The bottle assembly 22 further comprises a fitment 64 which is ultrasonically welded to a coupler 44, which is molded of a like thermoplastic material.

Figure 5:
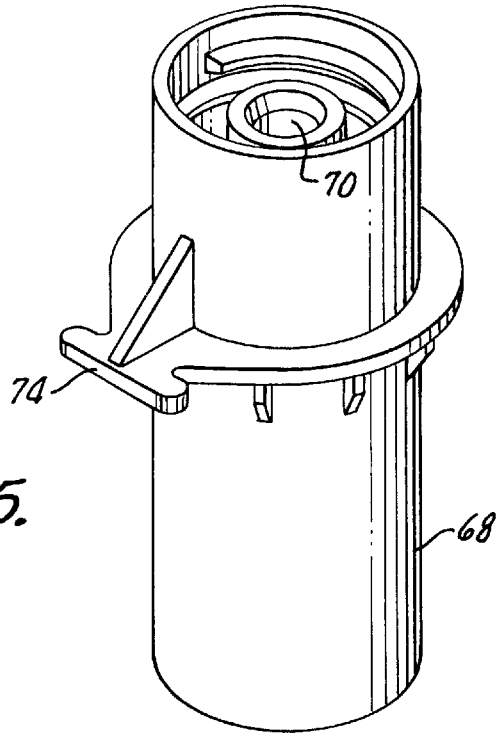
FIG. 5 is a view of an alternative embodiment of the present invention in which the coupler includes an alternative territorial flange.

An alternative coupler 68 is shown in FIG. 5, along with a pump 70 which may be identical to the pump 50 or designed for dispensing a fluid of different viscosity.

Figure 6:
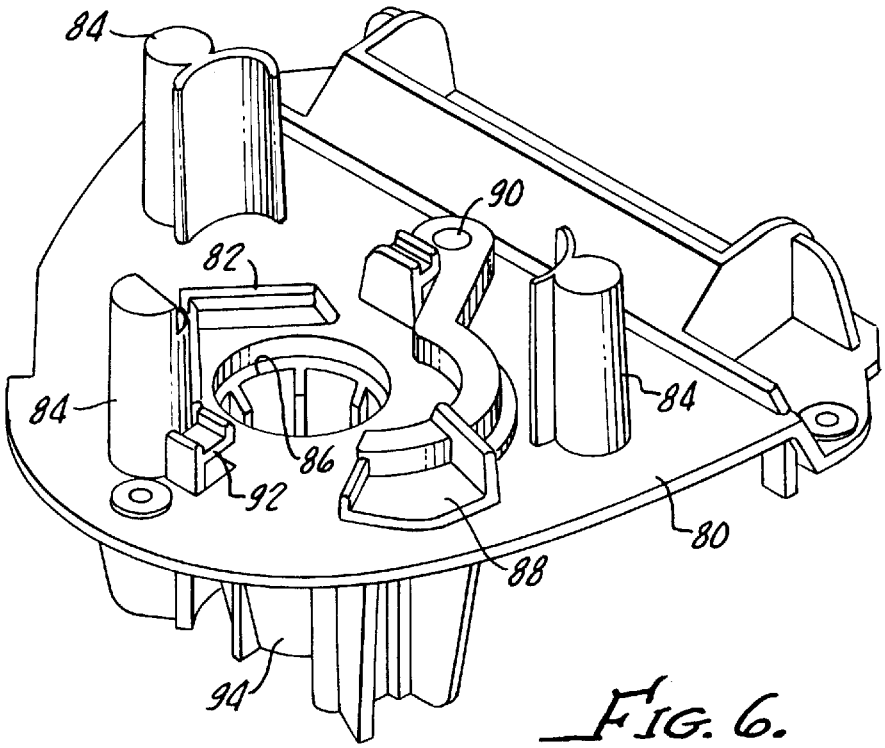
FIG. 6 is a perspective view of a frame in accordance with the present invention for supporting a collapsible bottle on a plurality of posts along with a snap arm provided for engaging the coupler flange to secure the bottle assembly to a topside of the frame.

The couplers 44, 68 are distinguished by differently shaped flanges 72, 74 for providing keyed engagement with a support frame 80, shown in FIG. 6.

As represented in FIG. 6, the frame 80 includes a depression 82 for enabling keyed capture of the flange 72. While not shown, a similar frame with a depression for engaging the flange 74 may be provided. Thus, the dispenser 10 utilizing alternate styles of flanges 72, 74 provide a form of territorial features which enable coupling in a unique and keyed manner with a matrix of bottle assemblies 22 for different customers, different products, or different geographic locations. Thus, the dispensers 10 are provided with a matching geometry to selectively allow or exclude the presence of bottle assemblies 22.

The bottle assembly 22 is supported on the frame 80 by a plurality of posts 84 and the frame 80 and includes an opening 86 therethrough for enabling the tip 46 to dispense fluid therethrough.

Utilizing an asymmetric shape of the flange 72 and the depression 82, keyed capture of the flange 72 and the locking to the frame 80 is enabled by a snap-arm 88 attached to the frame 80 by a pivot 90 for rotational engagement with the flange 72 and temporarily secure the in engagement therewith by a radial stop 92. Thus, actuation forces, as hereinafter described, in an upward direction, do not dislodge the bottle assembly 22 from the frame 80.

Figure 7:
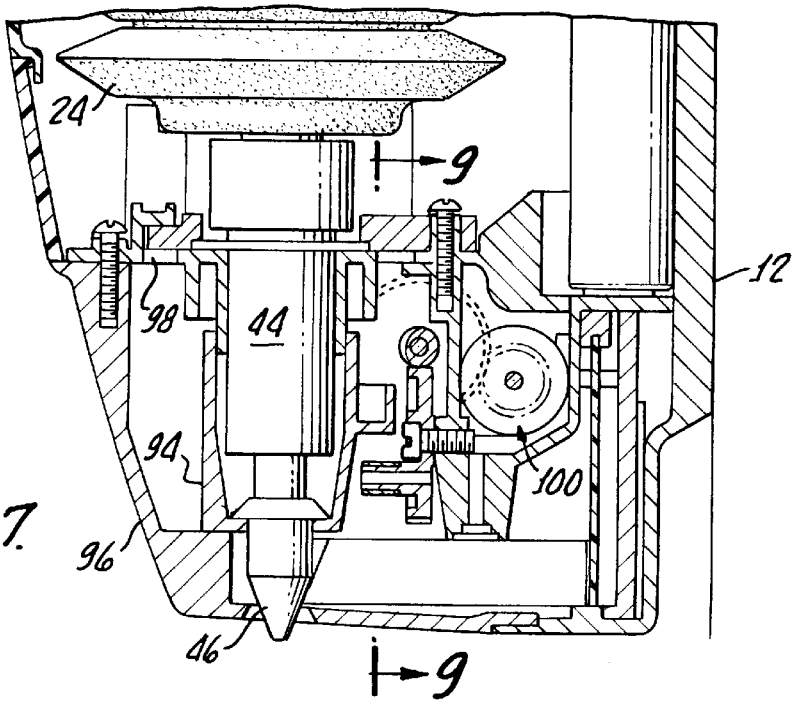
FIG. 7 is a cross-sectional view of the coupler and dispensing tip along with a pump actuator disposed on a bottom side of the frame for engaging the tip in order to actuate the pump along with the driver assembly disposed on the frame bottom side for operating the pump actuator and a controller for sensing the presence of a users hand and providing electrical signal to the driver.
Figure 8:
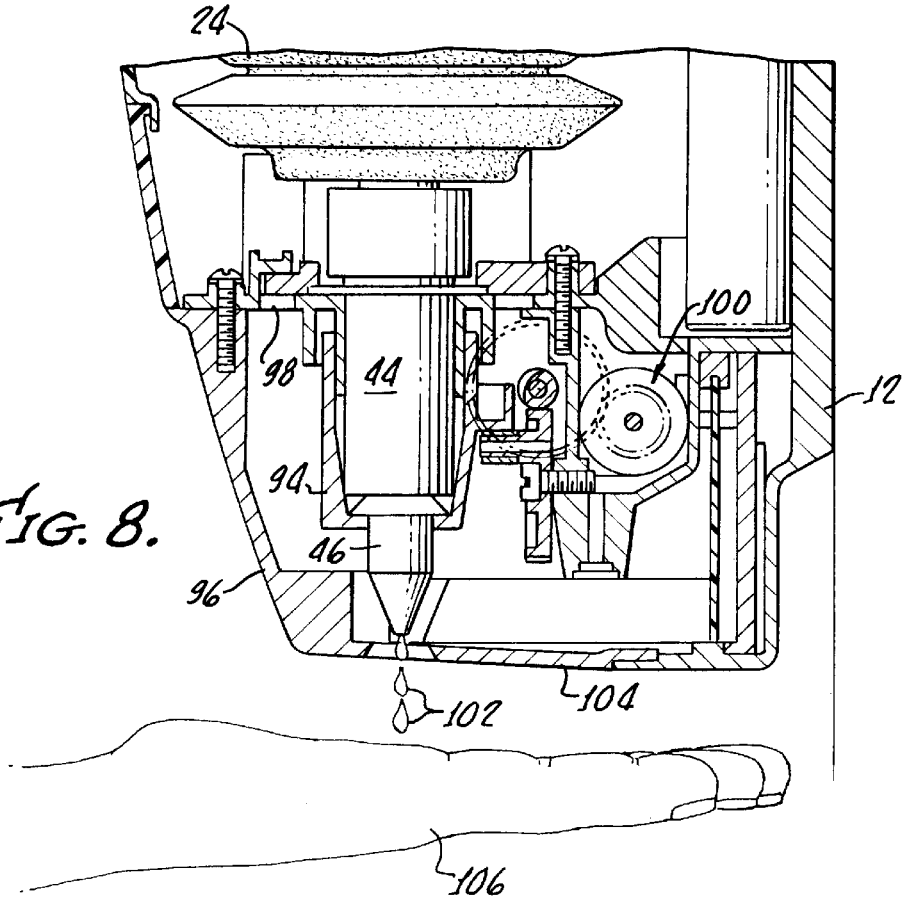
FIG. 8 is a cross-sectional view similar to that shown in FIG. 7 illustrating actuation of the driver by a users hand and movement of the actuator for causing metered dispensing of fluid through the tip by the pump disposed in the coupler.

As shown in FIGS. 7 and 8, the actuator 94 is enclosed by a nozzle housing 96. As shown, the pump actuator 94 is disposed on a bottom side 98 of the frame 36 for engaging the tip in order to actuate the pump 50, not shown in FIGS. 7 and 8. The actuator 94 is operated by a driver assembly 100 to lift the actuator 94, as shown in FIG. 8, to actuate the pump 50 in order to dispense a metered amount 102 of fluid, as shown in FIG. 8.

The driver assembly 100, also disposed on a bottom side 98 of the frame 36, operates the pump actuator in response to an electric signal provided by a controller 104 for sensing a presence of a user, for example, a hand 106. The controller may be of any suitable type, but preferably one is described in U.S. patent application Ser. No. 10/062,866, filed on Jul. 13, 2002. This application is to be incorporated herewith in its entirety including all drawings and specifications for describing a suitable controller for use with the touch free dispenser of the present invention.

Figure 9:
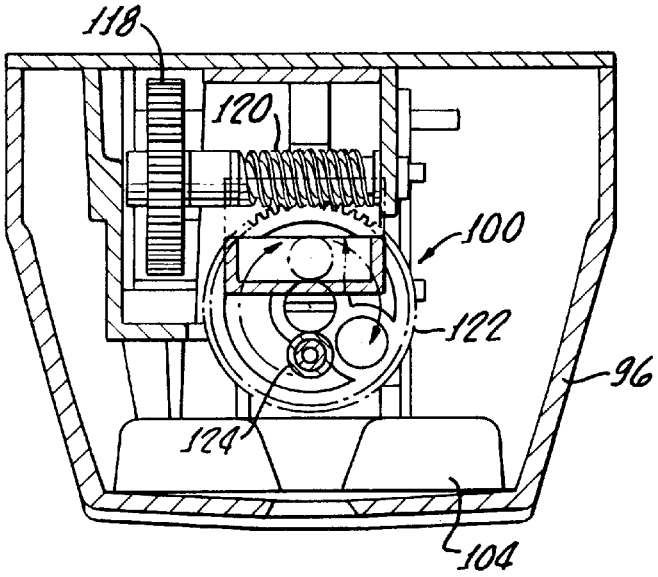
FIG. 9 is a cross-sectional view taken along the line 9—9 in FIG. 7 illustrating the driver assembly mechanism.
Figure 10:
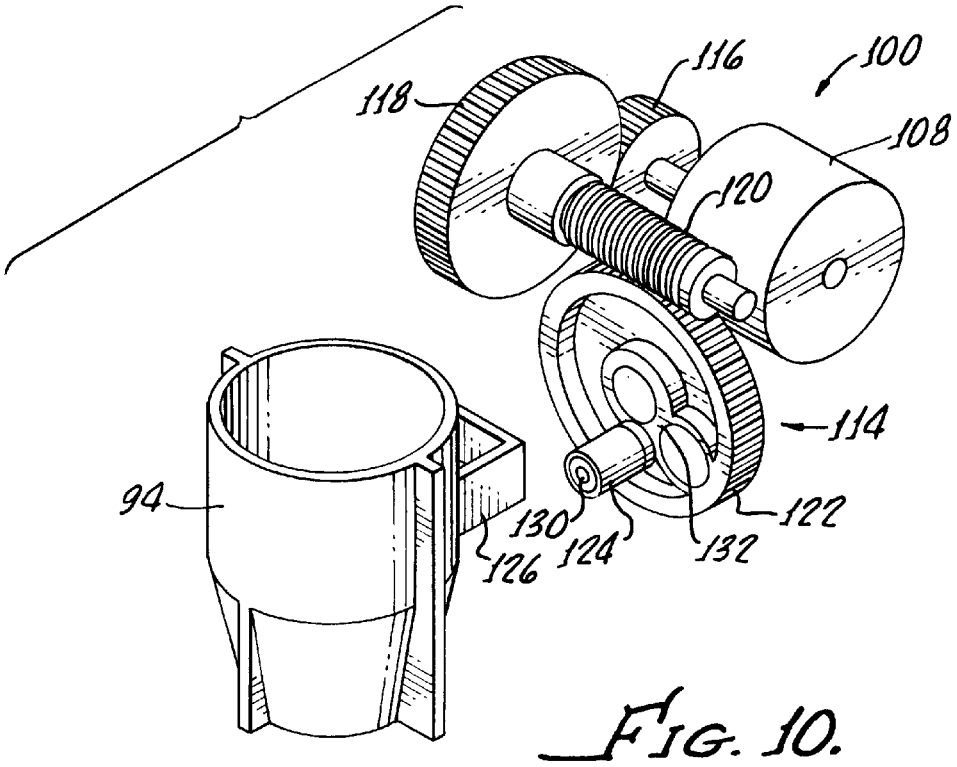
FIG. 10 is an exploded view of the actuator and the driver more clearly showing a rotating lifting arm and a lifting surface on the actuator for operating the pump.

The driver assembly 100, as shown in FIGS. 9 and 10, and includes a DC motor 108, powered by batteries 110 (see FIG. 2) and a set 114 of gears 116, 118, 120, 122, for translate rotary motion of the motor 108 into linear up-and-down motion of a cam, or rotated lifter 124, for engaging a lifting surface 126 on the actuator 94. The actuator 94 engages an outwardly extending flange 128 of the tip 46 and upward movement of the actuator 94 by the lifter 124 operates the pump 50 in a conventional manner.

More particularly, the motor 108 drives the spur gear 116, which in turn drives the large reduction gear 118 coupled to the worm drive 120. The worm gear 120 is coupled to a 90° following gear 122, which includes the roller lifter 124. As the roller lifter rotates clockwise on the face of the following gear 122 it imparts a linear motion to the actuator 94. The lifter 124 is captured on a small molded shaft 130 and on a face 132 of the following gear 122 but it is free to revolve around the shaft radially, thus reducing friction on the literary constrained pump lifter 124.

In operation, after the lifter 124 travels, past engagement with the lifting surface 124 it continues around in revolution, thus allowing the pump 50 to return to a rest position by virtue with its own internal spring (not shown) return force.

Although there has been hereinabove described a specific touch free dispenser in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element, which is not specifically disclose herein. Accordingly, any and all modifications, variations or equivalent arrangements, which may occur to those skilled in the art, should be considered to be within the scope of the present invention as defined in the appended claims.

What is claimed is:

1. A touch free dispenser comprising:

a bottle assembly for containing a dispensable fluid, said bottle assembly including a container with a dispensing coupler, a fluid pump disposed within the coupler and a dispensing tip, in fluid communication with the pump and container, for both activating the pump and dispensing the fluid;

a support frame for receiving said bottle assembly with said container supported on a top side of the frame, the frame having an opening therethrough for enabling the tip to dispense fluid therethrough;

a flange extending radially from said coupler;

a depression disposed in the frame top side for enabling keyed capture of said flange;

a pump actuator disposed on a bottom side of the frame, for engaging the tip in order to actuate the pump;

a driver assembly, disposed on the frame bottom side, for operating the pump actuator in response to an electric signal;

an arm, disposed on the frame topside for releasably engaging the frame; and a controller for sensing a presence of a user and providing the electric signal to the driver.

2. The dispenser according to claim 1 wherein said flange and said depression have corresponding asymmetric shapes.

3. The dispenser according to claim 1 wherein said container is collapsible.

4. The dispenser according to claim 3 wherein the container includes accordion like convolutions in walls of the container for enabling collapse.

5. The dispenser according to claim 3 wherein said bottle assembly is sealed and said coupler is fixed to the container.

6. A touch free dispenser comprising:

a bottle assembly for containing a dispensable fluid, said bottle assembly including a container with a dispensing coupler, a fluid pump disposed within the coupler and a dispensing tip, in fluid communication with the pump and container, for both activating the pump and dispensing fluid;

a support frame for receiving said bottle assembly with said container supported on a top side of the frame, the frame having an opening therethrough for enabling the tip to dispense fluid therethrough;

a pump actuator disposed on a bottom side of the frame, for engaging the tip in order to actuate the pump;

a driver assembly, disposed on the frame bottom side, for operating the pump actuator in response to an electric signal;

an arm disposed on the frame topside for releasably engaging the flange; and a controller for sensing a presence of a user and providing the electric signal to the driver.

7. The dispenser according to claim 6 wherein said dispensing tip includes an outwardly extending flange for engaging said pump actuator.

8. The dispenser according to claim 7 wherein said pump actuator surrounds said dispensing tip.

9. The dispenser according to claim 8 wherein said pump actuator includes a lifting surface and said driver assembly includes a rotated lifter for engaging said lifting surface during a portion of revolution thereof.

10. The dispenser according to claim 6 wherein said support frame includes a plurality of posts for supporting said collapsible container above the frame top plate.

11. A touch free dispenser comprising:

a sealed collapsible bottle assembly for containing a dispensable fluid, the assembly including a collapsible container with a depending coupler, a fluid pump disposed within the coupler and a dispensing tip, in fluid communication with the pump and container, for both activating the pump and dispensing the fluid, said couple including a flange;

a support frame for removably receiving the bottle assembly with the container supported on a top side of the frame, the frame having an opening therethrough for enabling the tip to dispense fluid therethrough;

a pump actuator, disposed on a bottom side of the frame, for engaging the tip in order to actuate the pump;

a driver assembly, disposed on the frame bottom side, for operating the pump actuator in response to the electronic signal;

an arm disposed on the frame top side for releasably engaging the flange with the bottle received by the frame; and a controller for sensing a presence of a user's hand proximate the dispensing tip and providing the electronic signal to the driver.

12. The dispenser according to claim 11 wherein said coupler is fixed to the container.

13. The dispenser according to claim 11 wherein said flange is asymmetric and the frame top side includes an asymmetric depression for enabling keyed capture of the frame therein.

14. The dispenser according to claim 11 wherein said collapsible container includes accordion like convolutions in walls of the container for enabling collapse thereof.

15. The dispenser according to claim 11 wherein said pump actuator surrounds said dispensing tip.

16. The dispenser according to claim 15 wherein said pump actuator includes a lifting surface and said driver assembly includes a rotated lifter for engaging said lifting surface during a portion of revolution thereof.

17. The dispenser according to claim 11 wherein said support frame includes a plurality of posts for supporting said collapsible container above the frame top plate.

* * * * *